US005639317A

United States Patent [19]

Yahagi et al.

[11] Patent Number: 5,639,317

[45] Date of Patent: Jun. 17, 1997

[54] HIGH STRENGTH, LOW THERMAL EXPANSION ALLOY WIRE AND METHOD OF MAKING THE WIRE

[75] Inventors: Shin-ichiro Yahagi, Ohbu; Kenji Takahashi, Chita; Hirotaka Yoshinaga, Tokai; Kenji Miyazaki, Osaka; Shinichi Kitamura, Osaka; Atsushi Yoshida, Osaka, all of Japan

[73] Assignees: Daido Steel Co. Ltd., Aichi-ken; Sumitomo Electric Industries Ltd., Osaka, both of Japan

[21] Appl. No.: 576,612

[22] Filed: Dec. 21, 1995

[30] Foreign Application Priority Data

| | | | |
|---|---|---|---|
| Jan. 23, 1995 | [JP] | Japan | 7-007940 |
| Jan. 23, 1995 | [JP] | Japan | 7-007941 |
| Jan. 23, 1995 | [JP] | Japan | 7-007942 |

[51] Int. Cl.[6] ..... C21D 8/06; C22C 38/08

[52] U.S. Cl. ..... 148/336; 148/599

[58] Field of Search ..... 148/599, 336; 420/94, 95, 97

[56] References Cited

U.S. PATENT DOCUMENTS 5,453,138 9/1995 Inoue et al. ..... 420/97

FOREIGN PATENT DOCUMENTS

| | | | |
|---|---|---|---|
| 56-142851 | 11/1981 | Japan | 148/599 |
| 58-77525 | 5/1983 | Japan | 420/95 |
| 406041634 | 2/1994 | Japan | 148/599 |

*Primary Examiner*—Deborah Yee

*Attorney, Agent, or Firm*—Nikaido, Marmelstein, Murray & Oram LLP

[57] ABSTRACT

In a high strength, low thermal expansion alloy wire, particularly used as the material for central section wire of low relaxation, overhead power transmission line, the number of rupture twisting is improved with retaining desired tensile strength (100 kgf/mm$^2$), elongation (1.5% or more) and linear thermal expansion coefficient (average in the range of room temperature to 300° C., $\alpha<5\times10^{-6}$/° C.). The wire is made of an Fe-Ni-based alloy of specifically selected alloy composition. Process for preparing the wire comprises, hot rolling the alloy material, peeling the rolled wire, cold drawing, annealing and surface coating the drawn wire. The above improvement can be achieved by carrying the hot wire rolling under such conditions that the quantity of intergranular precipitations is up to 2% and/or that the averaged crystal grain size in the rolling direction is in the range of 5–70 μm, at finishing the hot wire rolling.

5 Claims, 3 Drawing Sheets

* TENDS TO BREAK AT COLD WIRE DRAWING.

* TENDS TO BREAK AT COLD WIRE DRAWING.

HIGH STRENGTH, LOW THERMAL EXPANSION ALLOY WIRE AND METHOD OF MAKING THE WIRE

BACKGROUND OF THE INVENTION

The present invention concerns a high strength, low thermal expansion alloy wire. More specifically, the invention concerns a high strength, low thermal expansion alloy wire having a tensile strength of 100 kgf/mm$^2$ or higher and used as material for central section wire of low relaxation overhead power transmission line.

As the central section wire of the overhead power transmission line there has been used Fe-Ni based alloys or Fe-(Ni+Co) based alloys such as "Invar", Fe-36%Ni, "Kovar", Fe-29%Ni-17%Co and "Super Invar", Fe-36% (Ni+Co).

Fe and Ni are essential for controlling thermal expansion and used in combination in the most suitable proportion for realizing desired thermal expansion coefficient at the temperature ranges in which the alloys are used.

From the view to increase the strength, suitable amounts of various elements such as C, Si, Mn, Ti, Cr, Mo, W and Nb are added to form alloys which are practically used for the purpose of enhancing solid solution to heighten the matrix strength, or facilitating deposition of carbides/nitrides or intermetallic compounds.

Production of wire from these alloys is carried out generally by the following steps: blooming or forging alloy ingots or slabs made by casting or continuous casting—hot wire rolling—surface treatment (acid pickling or peeling)—wire drawing—softening annealing/aging—plating. Wire drawing and softening annealing may be repeated several times. Optionally, further wire drawing is carried out prior to the plating so as to increase strength by means of work hardening.

Strict requirements are claimed on the central section wire of the low relaxation power transmission line, such as (1) high strength (tensile strength 100 kgf/mm$^2$ or higher); (2) low thermal expansion (linear expansion coefficient, $\alpha$, up to $5\times10^{-6}$/° C. in the temperature range from room temperature to 300° C.); and (3) high elongation (1.5% or higher). In addition to these properties it is desired that the wire has (4) high rupture twisting (16 times or more). "Rupture twisting" means the number of rotation until rupture when an alloy wire with a gage length 100 times of the wire diameter is twisted at a rate of about 60 rpm. This is usually applied to testing the wire material for power transmission line.

In the conventional alloy wire made by working an alloy of known composition in an ordinary method of working can meet the requirements of (1) to (3) mentioned above, but it is difficult to keep the number of rupture twisting high. It is experienced that the number of rupture twisting is a property of significant dispersion, and therefore, it is necessary for providing reliable power transmission line to increase the number of rupture twisting to a higher level.

We have made research with the intention to provide a high strength, low thermal expansion alloy wire having improved number of rupture twisting without damaging other properties of the wire, and discovered that it is effective to carry out the above noted process for wire production by, in addition to the specifically chosen alloy composition, limiting the quantity of intergranular precipitations at finishing of hot wire rolling, more specifically, by suppressing the quantity of intergranular precipitation up to 2% (areal percentage) and by making the crystal grains to a specific fine state, more specifically, in the range of 5–70 μm. Even though satisfaction of one of these conditions may give a wire material of desired properties, if both of them are satisfied, then the product will have better properties.

The requirements of the intergranular precipitation and the crystal grain sizes may generally be realized by heat treatment for solid solution of the material after wire rolling (with efforts to keep the crystal sizes small). Needless to say, heat treatment requires time, labor and energy, which increase production costs, and therefore, it is desirable to eliminate the heat treatment step.

SUMMARY OF THE INVENTION

A general object of the present invention is to overcome the above noted difficulties in conventional technology and to provide a high strength, low thermal expansion alloy wire and a method of preparing the wire without damaging the other properties of the wire.

A more specific object of the invention is to provide a central section wire of low relaxation power transmission line with high reliability regarding the durability by using the above wire.

A further object of the invention is to provide an improved method of making the high strength, low thermal expansion alloy wire which satisfies the above noted requirements of intergranular precipitation and the crystal grain size without heat treatment for solid solution.

DETAILED EXPLANATION OF THE PREFERRED EMBODIMENTS

Figure 1:
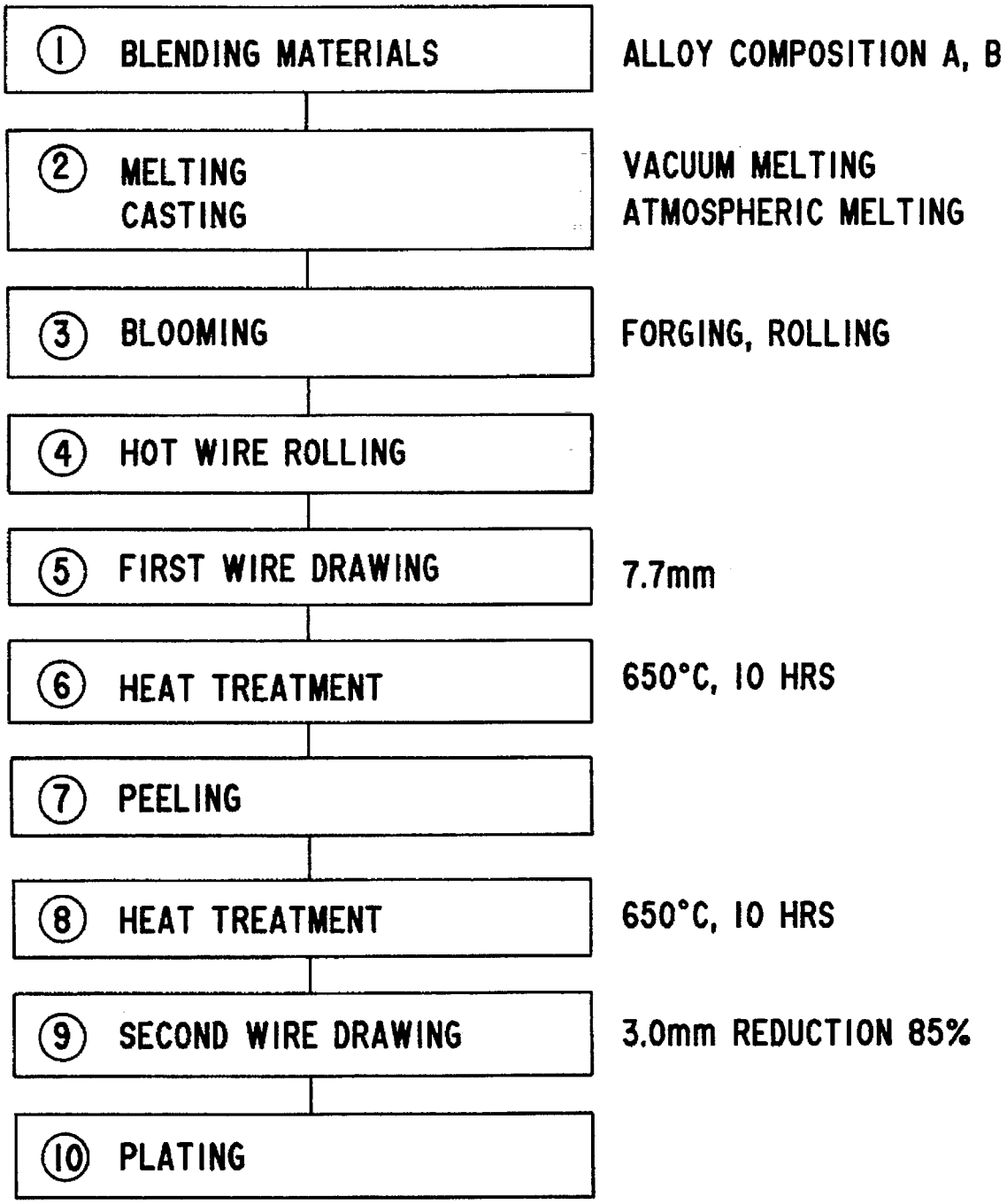
FIG. 1 is a block diagram showing steps of the method of making high strength, low thermal expansion alloy wire according to the invention.

One embodiment of the high strength, low thermal expansion alloy wire of the present invention is made of an Fe-Ni based alloy consisting essentially of, by weight, C 0.1–0.8%, at least one of Si and Mn 0.15–2.5% (in case of combined use, in total amount), at least one of Cr and Mo up to 8.0% (in case of combined use, in total amount), and Ni 25–40% and Co up to 10% (provided that Ni+Co 30–42%), and the balance of Fe, impurities in which being Al up to 0.1%, Mg up to 0.1%, Ca up to 0.1%, O up to 0.005% and N up to 0.008%; prepared by working the material in which the quantity of intergranular precipitation being up to 2% at the stage of finishing wire rolling; and having a strength of the final product 100 kgf/mm$^2$ or higher.

The method of making the above defined wire of high strength and low thermal expansion alloy comprises the steps of, after hot wire rolling, peeling, wire drawing, annealing and surface coating, the object of the working being the material in which quantity of the intergranular precipitation is up to 2% at the stage of finishing wire rolling.

Another embodiment of the high strength, low thermal expansion alloy wire of the present invention has the above defined alloy composition and the strength, and made by working the material in which the crystal grain sizes in the rolling direction are in the range of 5–70 μm at the stage of finishing wire rolling.

The method of making the above wire having the above defined alloy composition and the strength comprises the steps of, after hot wire rolling, peeling, wire drawing, annealing and surface coating, the object of the working being the material in which the crystal grain sizes in the rolling direction are in the range of 5–70 μm at finishing wire rolling.

The method of making the wire of high strength, low thermal expansion according to the invention may be defined from another point of view to comprise the steps of, after hot wire rolling, peeling, wire drawing, annealing and surface coating, and is characterized in that the hot wire rolling is carried out under the conditions of finishing temperature 900° C. or higher, reduction of area ln(So/S) ≧3.0 (here, So stands for the sectional area before rolling and S, the sectional area after rolling) and cooling at a cooling rate in the temperature range from finishing rolling to 700° C. at least 3.0° C./sec.

The reasons for limiting the alloy composition noted above are as follows.

Ni: 25–40%, Co: up to 10% (provided that Ni+Co: 30–42%)

These main components of the alloy are combined with the balance Fe in such proportion that realizes the above defined low thermal expansion coefficient (linear expansion coefficient α in the range from room temperature to 300° C.: up to $5\times10^{-6}$/° C.).

C: 0.1–0.8%

In order to achieve tensile strength of 100 kgf/mm$^2$ or higher after work hardening caused by the secondary wire drawing it is necessary that carbon is contained in the alloy in an amount of 0.1% or more. On the other hand, too much content of carbon increases the thermal expansion. At the higher content the alloy becomes so brittle that the requirement of elongation, 1.5% or higher, may not be achieved. Thus, 0.8% is the upper limit. Preferable carbon content is in the range of 0.2–0.5%.

One or both of Si and Mn (in case of combined use, in total): 0.15–2.5%

One or both of Si and Mn are used as deoxidizing agents of the alloy. To ensure the deoxidizing effect addition of 0.15% is necessary. However, both the elements enhance the thermal expansion, and thus, 2.5% is set as the upper limit.

One or both of Cr and Mo (in case of combined use, in total): up to 8.0%

These elements strengthen the alloy and are useful to establish high strength due to work hardening and precipitation hardening. Too high contents increase the thermal expansion, and therefore, 8.0% in total is the upper limit of addition Al: up to 0.1%, Mg: up to 0.1%, Ca: up to 0.1%

These elements may be added for the purpose of deoxidizing and hot workability. The contents of such occasion, usually 0.1% or so, are not harmful to the alloy properties. Higher contents will damage palatability, and the above upper limit of 0.1% each is given.

O: up to 0.005%, N: up to 0.008%

These elements form oxide and nitrides, respectively, which, if exist at the grain boundaries, will prevent stabilization of the number of rupture twisting, and therefore, it is desirable to decrease contents of these impurities. The above upper limits, O: 0.005% and N: 0.008% are the allowable limits.

There is a critical relation between the quantity of intergranular precipitation at the stage of hot wire rolling and the number of rupture twisting as seen from the working examples below. If the quantity of precipitation does not exceed 2%, then the number of rupture twisting may be maintained at a high level, and if it exceeds 2%, the number significantly decreases. We have discovered that the quantity of intergranular precipitation at the time of hot wire rolling is retained in the subsequent steps of working, and that it controls the properties of the final products wire. The intergranular precipitations are mainly of carbides, especially, molybdenum carbides, to which some quantity of nitrides accompany.

The quantity of intergranular precipitations is also correlated to the crystal grain sizes. We have also discovered that, if the averaged crystal grain size measured in the rolling direction is in the range of 5–70 μm at the stage of finishing the hot wire rolling, quantity of the intergranular precipitations is small. Crystal grain sizes will be smaller if the hot working is done at a lower temperature. However, at a lower temperature precipitations are easily formed and tend to occur at the grain boundaries, and hence it is not preferable to use a too low working temperature. On the other hand, if working is done at a high temperature, precipitations such as carbides will disappear by being solid dissolution. However, the crystal grain sizes will be larger, which is not preferable from the view to stabilize the number of rupture twisting.

As the means for controlling the quantity of precipitations at grain boundaries it is important to choose temperature of hot rolling and reduction ratio to suitable levels, and to make the cooling rate after rolling as rapid as possible. Solution treatment after hot rolling is effective from the view point of decreasing the quantity of precipitations. On the other hand, however, the treatment causes increase of crystal grain sizes, and therefore, this is not always useful means.

There is a critical relation between the crystal grain sizes at the stage of finishing hot wire rolling and the number of rupture twisting as shown in the working examples described later. The crystal grain sizes in the range of 5 μm to 70 μm will retain the number of rupture twisting at a high level, while sizes finer than 5 μm and coarser than 70 μm will deteriorate the number significantly. It was found that, though the crystal grain sizes at the stage of finishing hot wire rolling may change in the subsequent working steps, it controls the mechanical properties of the final product wire.

With respect to the means for controlling the crystal grain sizes the above discussion on the quantity of intergranular precipitations may be applied almost as it is. In other words, it is useful to choose the temperature of hot wire rolling and the reduction ratio to suitable levels and to make the cooling rate as rapid as possible. Working at a low temperature will give smaller crystal grain sizes, while much more precipitations are formed, particularly at the grain boundaries. It is, therefore, not preferable to use a too low working temperature. On the other hand, working at a high temperature will result in growth of crystals and disadvantageous as discussed in regard to the intergranular precipitations It was also found that there is correlation between the crystal grain sizes and the quantity of intergranular precipitations. In case where the averaged crystal grain size in the rolling direction is in the range of 5 to 70 μm, quantity of the intergranular precipitations is less than 2%.

The reasons why the conditions of hot wire rolling and the subsequent treatments are chosen as noted above are as follows:

Finishing temperature: 900° C. or higher

In order to dissolve the carbides which may form the intergranular precipitations it is necessary to use a somewhat high temperature. However, too high a temperature makes the crystal grain coarser, compromise was done to choose a temperature which is lower than the temperature used for conventional wire rolling of this kind of alloy. If the finishing temperature is too low, then the deformation resistance at rolling is high and too much load will be incurred on the rolling mill.

Reduction Ratio: $\ln(So/S) \geqq 3.0$

A higher reduction ratio solves the problem of micro segregation and makes the crystal grain finer. For example, in case where a round rod of diameter 80 mm is rolled to a wire rod of diameter 12 mm, $\ln(So/S)=3.8$; and in case where a billet of 145 mm square is rolled to a wire rod of diameter 9 mm, $\ln(So/S)=5.8$. Lower reduction ratios allow cast structures to remain, and result in increased quantity of carbides at grain boundaries, which decreases the number of rupture twisting of the final product wire. Insufficient reduction is also a cause of coarser crystal grain sizes, and at the same time, unfavorable increase of intergranular carbides.

Cooling Rate: 3.0° C./sec or higher in the range from finishing of rolling down to 700° C Too low a cooling rate increases quantity of intergranular carbides. Also, the crystal grain sizes will be larger at a low cooling rate, which lowers elongation of the final product wire. In order to reach to a low temperature while preventing formation of precipitations, it is necessary to cool as rapid as possible. The cooling rate of 40° C./sec is the highest cooling rate practicable by air cooling with blowers.

The present invention provides an Fe-(Ni+Co) based high strength, low thermal expansion alloy of a strength of 100 kgf/mm$^2$ or higher, which retains the physical properties inherent to the alloy and has improved number of rupture twisting. The alloy will give, when used as the central section wire for low relaxation overhead power transmission line, products of high reliability.

EXAMPLES

Example 1

A high strength, low thermal expansion alloy was produced in accordance with the sequence of steps shown in FIG. 1.

(1) Blending of materials

In accordance with the alloy compositions to be produced, 42 Ni-alloy or Super Invar alloy are combined to Fe-sources (scrap iron or electrolytic iron) and Ni-sources (electrolytic nickel or ferronickel), and determined amounts of the alloying elements (C, Si, Mn, Cr, Mo, V) were added thereto.

(2) Melting and Casting

The above mentioned blended materials were charged in a vacuum induction furnace and melted under vacuum (e.g., $10^{-2}$ Torr) or in an inert gas (Ar) atmosphere. The molten metal was cast into columnar ingots of diameter 100 mm to obtain "Alloy A" of the composition shown in Table 1. Also, by melting in an atmosphere induction furnace "Alloy B" was obtained, composition of which is also shown in Table 1.

TABLE 1

| Alloy | C | Si | Mn | Cr | Mo | Ni | Co | Al | Mg | Ca | O | N |
|---|---|---|---|---|---|---|---|---|---|---|---|---|
| A | 0.25 | 0.51 | 0.20 | 0.98 | 2.01 | 35.0 | 3.14 | 0.03 | 0.02 | 0.01 | 15 | 13 |
| B | 0.30 | 0.75 | 0.30 | 0.70 | 1.53 | 38.3 | 0.25 | 0.08 | 0.01 | 0.01 | 14 | 15 |

Contents of C to Ca are in weight %; O and N are in ppm; the balance being Fe.

(3) Forging or Blooming

The ingot of "Alloy A" was heated to a temperature typically 1250° C. and forged to form a round rod of diameter 75 mm. The ingot of "Alloy B" was also heated to a temperature typically also 1250° C. and bloomed.

(4) Hot Wire Rolling

The round rods prepared by the forging or the blooming were further heated to various temperatures in the range of 900–1280° C. and hot rolled to be wire of diameter 12 mm. Cooling rates after the hot rolling was varied and combined with various heating temperatures so that the quantities of the intergranullar precipitations and the crystal grain sizes may be varied.

At this stage the crystal grain sizes and the quantity of intergranular precipitations were determined. Test pieces are cut in the longitudinal section (along the rolling direction). The cut surfaces were polished and etched with 5%-nital solution for 40 seconds, and then photographs were taken by a scanning type electron microscope at magnitude 4000. The photographs thus taken were treated in an automatic image processing apparatus "Loozex" to average the sizes of crystal grains in the rolling direction, which were regarded as the crystal grain sizes. Also, the areal percentages of the precipitations existing at the grain boundaries were calculated, which were regarded as the quantity of the intergranular precipitations.

(5) Peeling

Surfaces of the wire rods of diameter 12 mm were peeled by dicing to remove the oxidation scale and flaws. The diameter of the peeled wire rods is reduced to 9.0 mm.

(6) First Wire Drawing

The wire rods after peeling were cold drawn to be wire rods of diameter 8.0 mm.

(7) Annealing and Aging

The wire rods of diameter 8.0 mm after the above cold drawing were subjected to heating at 700° C. for 30 minutes for annealing and age hardening.

(8) Second Wire Drawing

The wire rods after being heated were cold drawn to wires of diameter 3.0 mm.

(9) Plating

In order to use the above produced wires as the central section wire of overhead power transmission line, it is necessary to enhance corrosion resistance of the wires. The above wire of diameter 3.0 mm were dipped in a molten Zn-Al alloy bath to plate.

The plated wires were subjected to the tests for determining number of rupture twisting (the testing method is described above) and elongation (at rapture in tensile test), and linear thermal expansion coefficient (averaged value in the range of 30°–300° C.) measurement.

In addition to the above measurements of the intergranular precipitations and crystal grain sizes after the hot wire rolling the number of rapture twisting, tensile strength, elongation and thermal expansion coefficients are shown in Table 2.

TABLE 2

| No. | Alloy | Inter granular Precipitation (%) | Crystal Grain Size (μm) | Tensile Strength (kgf/mm2) | Elonga-tion (%) | Number of Rupture Twisting (Times/100d) | Linear Thermal Expansion Coeff. |
|---|---|---|---|---|---|---|---|
| Examples | | | | | | | |
| 1 | A | 0.05 | 82 | 132.3 | 2.0 | 113 | 3.8 |
| 2 | A | 0.12 | 65 | 131.9 | 2.2 | 105 | 3.6 |
| 3 | A | 0.24 | 53 | 134.0 | 1.6 | 112 | 3.7 |
| 4 | B | 0.42 | 26 | 135.0 | 1.7 | 107 | 3.5 |
| 5 | B | 1.10 | 17 | 136.1 | 1.6 | 98 | 3.4 |
| 6 | B | 1.5 | 22 | 135.6 | 1.6 | 103 | 3.6 |
| Controls | | | | | | | |
| 1 | A | 2.40 | 72 | 132.9 | 1.9 | 42 | 3.5 |
| 2 | B | 2.75 | 4 | 138.5 | 1.5 | 53 | 3.4 |

Figure 2:
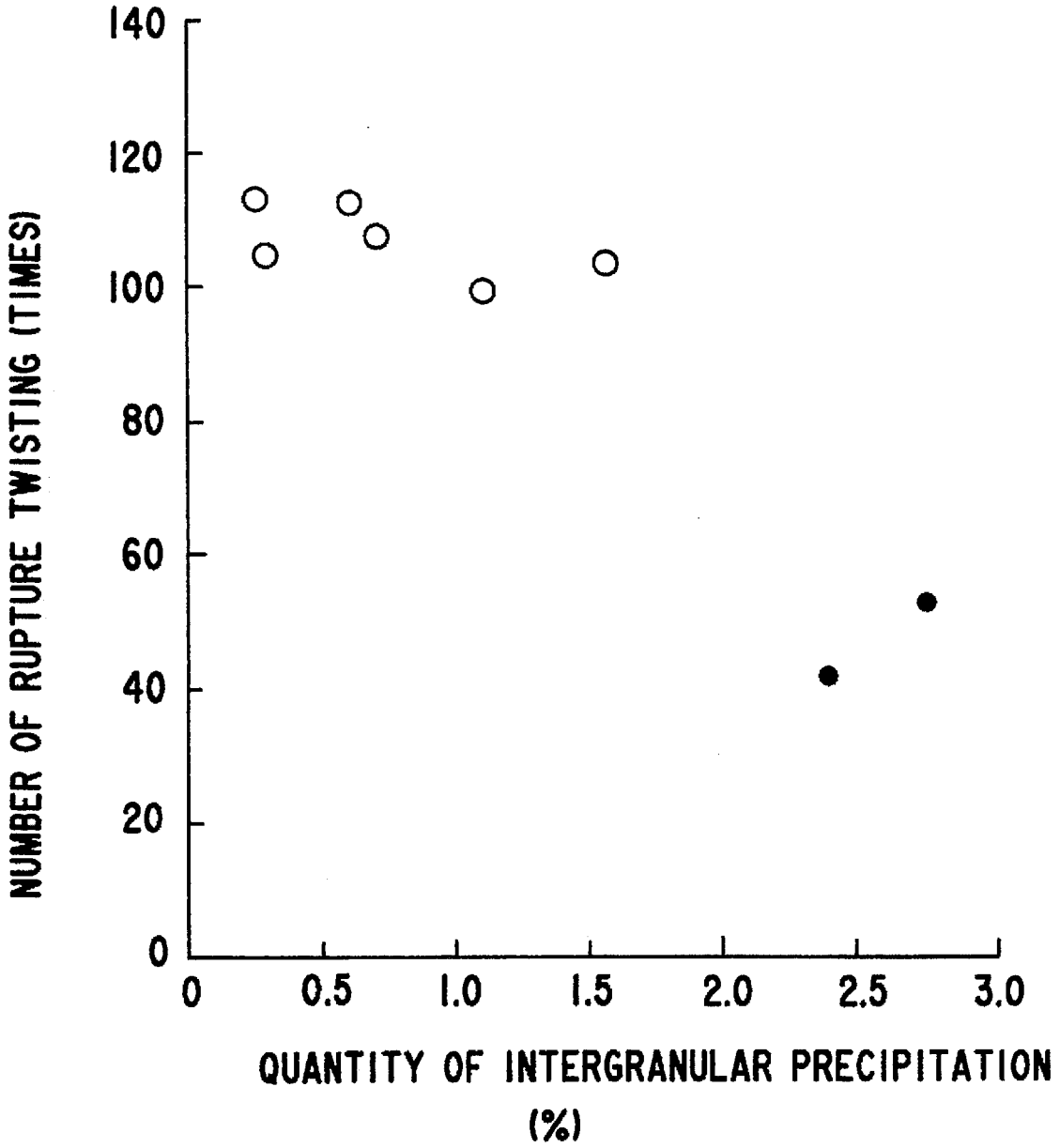
FIG. 2 shows data of working examples of the present invention, a graph of the relation between quantity of intergranullar precipitation at the stage of hot wire rolling in the production of high strength, low thermal expansion alloy wire and the number of rupture twisting of the wire products.

The relation between the intergranular precipitations and the number of rupture twisting shown in Table 2 is illustrated in the graph of FIG. 2.

As clearly understood from Table 2 and FIG. 2, when the quantity of the intergranullar precipitations does not exceed 2% at the stage of finishing hot wire rolling, higher rupture twisting can be achieved.

Example 2

In the stage of hot wire rolling in Example 1 some specimens were subject only to measurement of the crystal grain sizes with a scanning type electron microscope. The wire products after plating were also subjected to the tests for rupture twisting (testing method is described above), elongation (at rupture in tensile test) and linear thermal expansion coefficient (averaged value in the range of 30°–300° C.) measurement.

In addition to the above measurements of quantity of intergranular precipitations and crystal grain sizes after the hot wire rolling the number of rupture twisting, the tensile strength, the elongation and the thermal expansion coefficients obtained are shown in Table 3.

Figure 3:
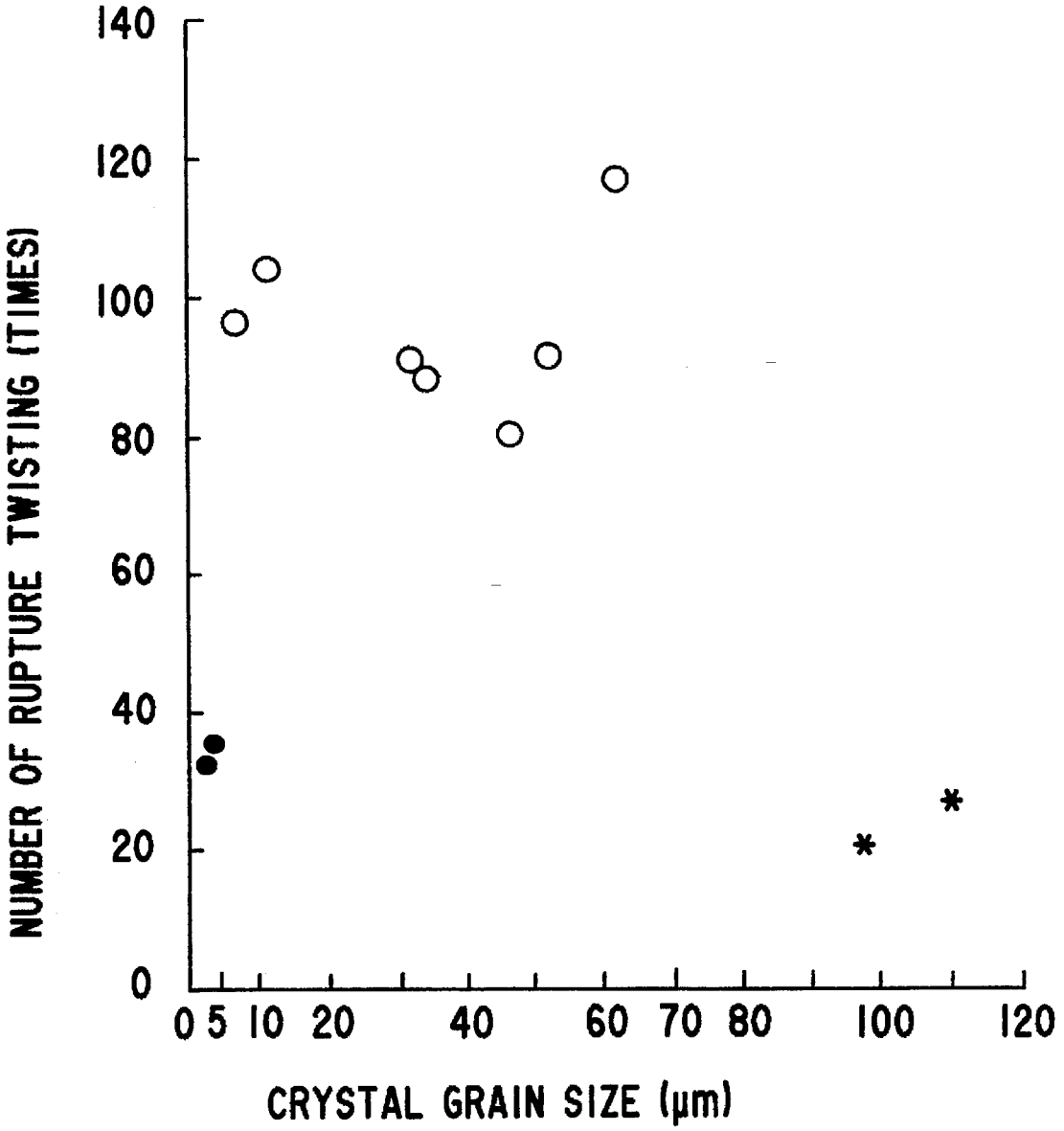
FIG. 3 also shows data of working examples of the present invention, a graph of the relation between averaged crystal grain sizes in the rolling direction at the stage of hot wire rolling in the production of high strength, low thermal expansion alloy wire and the number of rupture twisting of the wire products.

The relation between the quantity of the intergranular precipitations and the number of rupture twisting shown in Table 3 is illustrated in the graph of FIG. 3.

In control examples 12 and 14 breaking up of the wire often occurred during drawing. Due to the extremely low production efficiency and yield, it was concluded that these embodiments are not suitable for industrial practice.

As clearly understood from Table 3 and FIG. 3, when the crystal grain sizes are in the range of 5–70 μm at the stage of hot wire rolling, increase in the numbers of rupture twisting can be achieved.

Example 3

"Alloy C" and "Alloy D" of the alloy compositions shown in Table 4 were prepared.

"Alloy C" was prepared by melting under vacuum (e.g., $10^{-2}$ Torr) or in an inert gas (Ar) atmosphere, while "Alloy D" was prepared in an atmosphere induction furnace.

TABLE 3

| No. | Alloy | Crystal Grain Size (μm) | Tensile Strength (kgf/mm2) | Elonga-tion (%) | Number of Rupture Twisting (Times/100d) | Linear Thermal Expansion Coeff. |
|---|---|---|---|---|---|---|
| Examples | | | | | | |
| 11 | A | 7 | 135.4 | 1.7 | 97 | 3.6 |
| 12 | A | 31 | 132.8 | 2.1 | 91 | 3.6 |
| 13 | A | 46 | 134.1 | 1.8 | 81 | 3.7 |
| 14 | B | 52 | 130.0 | 1.5 | 92 | 3.8 |
| 15 | B | 12 | 137.1 | 1.6 | 104 | 3.4 |
| 16 | B | 33 | 131.0 | 1.8 | 90 | 3.4 |
| 17 | B | 61 | 132.4 | 1.7 | 117 | 3.5 |
| Controls | | | | | | |
| 11 | A | 4 | 136.5 | 2.7 | 35 | 3.8 |
| 12 | A | 98 | 131.4 | 1.3 | 21 | 3.7 |
| 13 | B | 3 | 137.2 | 1.9 | 33 | 3.3 |
| 14 | B | 111 | 132.2 | 1.6 | 27 | 3.4 |

TABLE 4

| Alloy | C | Si | Mn | Cr | Mo | Ni | Co | Al | Mg | Ca | O | N |
|---|---|---|---|---|---|---|---|---|---|---|---|---|
| C | 0.25 | 0.51 | 0.20 | 0.98 | 2.01 | 35.0 | 3.14 | 0.03 | 0.02 | 0.01 | 15 | 13 |
| D | 0.30 | 0.75 | 0.30 | 0.70 | 1.53 | 38.3 | 0.25 | 0.08 | 0.01 | 0.01 | 14 | 35 |

Contents of C to Ca are in weight %; O and N are in ppm; the balance being Fe.

Ingots of Alloy C were heated to 1250° C. and forged to billets having sections of 145 mm square or diameter 75 mm. Also, ingots Alloy D were bloomed at 1250° C. to round billets of diameters 50 mm, 70 mm or 80 mm.

The materials prepared by the above forging or blooming step were heated to various temperatures ranging from 1280° down to 900° C. and rolled to produce hot rolled wire products. The wire sizes after rolling were varied in the range of 9–15 mm.

At the hot wire rolling finishing temperatures and cooling rates after rolling to 700° C. were controlled. Cooling after rolling was forced air cooling with blowers or quenching in water, and amount of blasting and water supply were chosen to control the cooling rates.

The operation conditions of hot rolling and the cooling rates are shown in Table 5.

At this stage quantity of the intergranular precipitations and the crystal grain sizes were determined. Testing methods used are the same as those in Example 1.

Peeling of the rolled wires was done as in Examples 1 and 2, and the peeled alloy wires were subjected to cold wire drawing to reduce the diameter to 7.75 mm.

The above wires of diameter 7.75 mm were heat treated by being heated to 650° C. for 10 hours so as to obtain softening and age hardening effects.

After the heat treatment, in order to remove surface oxide scales and flaws the wires were passed through a die to peel the surface. Then, through the second wire drawing step or cold drawing, alloy wires of diameter 3.0 mm were produced. Reduction was 85%.

The above wires of diameter 3.0 mm were plated by dipping in molten Zn-Al alloy bath as in Examples 1 and 2.

The alloy wires after being plated were subjected to the tests of twisting (by the method as describe above; averaged values of 10 samples and standard deviations were calculated.), elongation (at the time of rapture in tensile test), and linear thermal expansion coefficients (average in the range of 30°–300° C.) measurement.

Table 6 shows, in addition to the above mentioned quantity of the intergranular precipitations and crystal grain sizes, observed values of the number of rupture twisting, the tensile strength and the elongation. The thermal expansion coefficients were $3.6–3.8\times10^{-6}/°$ C. for Alloy C, and $3.4–3.6\times10^{-6}/°$ C. for Alloy D.

TABLE 5

| No. | Alloy | Size of Hot-rolled Material: extracted | Size of Hot-rolled Material: rolled | Reduction ln (So/S) | Finishing Temp. (°C.) | Cooling Rate (°C./sec) | Way of Cooling |
|---|---|---|---|---|---|---|---|
| 21 | C | 145B | 15 | 4.78 | 1050 | 4.5 | air-1* |
| 22 | C | 145B | 12 | 5.2 | 1050 | 7.2 | air-2 |
| 23 | C | 145B | 10.5 | 5.49 | 1050 | 8.3 | air-3 |
| 24 | D | 80 | 10.5 | 4.06 | 1050 | 7.0 | air-2 |
| 25 | D | 70 | 12 | 3.59 | 1000 | 7.5 | air-2 |
| 26 | D | 70 | 8 | 4.10 | 1100 | 40.0 | water |
| Controls | | | | | | | |
| 21 | C | 145B | 12 | 6.53 | 1100 | 2.0 | air-0 |
| 22 | C | 70 | 10.5 | 8.79 | 880 | 5.0 | air-1 |
| 21 | D | 145B | 15 | 4.78 | 1050 | 1.5 | air-0 |

*The number after "air" shows the number of blowers used.

TABLE 6

| No. | Alloy | Rolled Wire: Crystal Grain Size (μm) | Rolled Wire: Carbides at Grain Boundaries (areal %) | Tensile Strength (kgf/mm2) | Final Products: Elongation (%) | Final Products: Number of Rupture Twisting (Times/100d) | Stand'd Deviation |
|---|---|---|---|---|---|---|---|
| Examples | | | | | | | |
| 21 | C | 26 | 1.1 | 132.3 | 2.0 | 115 | 9 |
| 22 | C | 21 | 0.13 | 134.3 | 2.1 | 125 | 5 |
| 23 | C | 17 | 0.05 | 136.5 | 2.2 | 120 | 7 |
| 24 | D | 47 | 0.05 | 135.2 | 1.8 | 122 | 6 |
| 25 | D | 55 | 0.06 | 138.3 | 1.6 | 123 | 6 |
| 26 | D | 12 | 0.02 | 132.8 | 2.2 | 127 | 5 |
| Controls | | | | | | | |
| 21 | C | 76 | 2.4 | 132.2 | 1.6 | 75 | 22 |
| 22 | C | 4 | 2.2 | 137.7 | 1.4 | 61 | 33 |
| 23 | D | 82 | 3.1 | 131.5 | 1.5 | 82 | 25 |

As clearly seen from the data of Table 5 and Table 6 improved number of rapture twisting can be obtained by choosing the conditions of hot wire rolling and subsequent working in accordance with the present invention.

We claim:

1. A high strength, low thermal expansion alloy wire made of an Fe-Ni-based alloy consisting essentially of, by weight, C 0.1–0.8%, at least one of Si and Mn 0.15–2.5% (in case of combined use, total amount), at least one of Cr and Mo up to 8.0% (in case of combined use, total amount), and Ni 25–40% and Co up to 10% (provided that Ni+Co 30–42%), and the balance of Fe, in which impurities being Al up to 0.1%, Mg up to 0.1%, Ca up to 0.1%, O up to 0.005% and N up to 0.008%; prepared by working the alloy material in which the quantity of intergranular precipitations is up to 2% at the stage of finishing wire rolling; and having a strength of 100 kgf/mm$^2$ or higher at the final product size.

2. A method of preparing an alloy wire having the alloy composition and the strength defined in claim 1, comprising the processing steps of, at least, hot wire rolling the alloy material, peeling the rolled wire, cold wire drawing, annealing and surface coating of the drawn wire; the object of the processing being the material in which quantity of intergranular precipitations is up to 2% at finishing hot wire rolling.

3. A high strength, low thermal expansion alloy wire having the alloy composition and the strength defined in claim 1, prepared by processing the alloy material in which averaged crystal grain size in the rolling direction is in the range of 5–70 μm at finishing the hot wire rolling.

4. A method of preparing an alloy wire having the alloy composition and the strength defined in claim 1, comprising the processing steps of, at least, hot wire rolling the alloy material, peeling the rolled wire, cold wire drawing, annealing and surface coating of the drawn wire, the object of the processing being the material in which the crystal grain size in the rolling direction is in the range of 5–70 μm at finishing the hot wire rolling.

5. A method of preparing alloy wire according to one of claims 2 and 4, wherein the hot wire rolling is carried out under the conditions of: finishing temperature 900° C. or higher; reduction of area $\ln(So/S) \geqq 3.0$ (So stands for the sectional area before rolling; and S, the sectional area after rolling); and cooling at a cooling rate of at least 3.0° C./sec in the temperature range from finishing rolling down to 700° C.

* * * * *